US009347196B2

(12) United States Patent
Wagler

(10) Patent No.: US 9,347,196 B2
(45) Date of Patent: May 24, 2016

(54) POST-FRAME FOOTING ASSEMBLY AND VERTICAL POST

(71) Applicant: Bennie R. Wagler, Montgomery, IN (US)

(72) Inventor: Bennie R. Wagler, Montgomery, IN (US)

( * ) Notice: Subject to any disclaimer, the term of this patent is extended or adjusted under 35 U.S.C. 154(b) by 0 days.

(21) Appl. No.: 14/502,584

(22) Filed: Sep. 30, 2014

(65) Prior Publication Data

US 2015/0225919 A1 Aug. 13, 2015

Related U.S. Application Data

(60) Provisional application No. 61/936,987, filed on Feb. 7, 2014.

(51) Int. Cl.

| | |
|---|---|
| ***E02D 27/00*** | (2006.01) |
| ***E02D 27/42*** | (2006.01) |
| ***E04H 12/22*** | (2006.01) |
| ***E04C 3/32*** | (2006.01) |
| *E04H 17/22* | (2006.01) |

(52) U.S. Cl.

CPC . *E02D 27/42* (2013.01); *E04C 3/32* (2013.01); *E04H 12/2253* (2013.01); *E02D 2200/115* (2013.01); *E02D 2600/20* (2013.01); *E04H 17/22* (2013.01)

(58) Field of Classification Search

CPC ..... E02D 27/42; E02D 2200/115; E02D 2600/20; E04H 12/2253; E04H 17/22; E04C 3/32

USPC ..... 52/166, 169.9, 170, 292, 296, 298, 299, 52/678

See application file for complete search history.

(56) References Cited

U.S. PATENT DOCUMENTS

| | | | | | |
|---|---|---|---|---|---|
| 2,551,826 | A | * | 5/1951 | Cox, Sr. | 52/678 |
| 2,849,202 | A | | 8/1958 | Mccombs | |
| 3,257,763 | A | * | 6/1966 | Hammitt | 52/239 |
| 3,257,765 | A | | 6/1966 | Anderson | |
| 3,267,627 | A | * | 8/1966 | Hammitt | 52/298 |
| 3,282,001 | A | * | 11/1966 | Bigalow | 52/292 |
| 3,311,333 | A | | 3/1967 | Galloway | |
| 3,630,474 | A | | 12/1971 | Minor | |
| 3,768,130 | A | | 10/1973 | Jury | |
| 3,839,835 | A | | 10/1974 | Meyer | |
| 3,921,356 | A | * | 11/1975 | Hughes | 52/299 |
| 4,313,688 | A | * | 2/1982 | Daniels | 403/189 |
| 4,785,593 | A | | 11/1988 | Munoz, Jr. | |
| 4,995,206 | A | * | 2/1991 | Colonias et al. | 522/97 |
| 5,013,190 | A | * | 5/1991 | Green | 405/230 |

(Continued)

*Primary Examiner* — James Buckle, Jr.

(74) *Attorney, Agent, or Firm* — Daniel Badwin; Global Intellectual Property Agency, LLC

(57) ABSTRACT

A footing assembly for a vertical post in post-frame construction is provided that supports three-axis loading and facilitates proper locating of the vertical post within a drilled hole. The footing assembly comprises post rail assembly that is slidably disposed within an elongated bridge plate member. A vertical post is furthermore slidably received within the post rail assembly along the vertical post lower end. The slidable connections of the post rail assembly and the vertical post facilitate two-axis position of the vertical post within an excavated hole once placed therein, while the telescoping construction of the vertical post facilitates a vertical positioning of a post bracket secured to the upper portion of the vertical post. The present invention allows for proper locating of a vertical post within a footing hole, while also providing a footing assembly that supports three-axis loading once installed.

8 Claims, 3 Drawing Sheets

(56) References Cited

U.S. PATENT DOCUMENTS

| | | | | |
|---|---|---|---|---|
| 5,301,485 | A * | 4/1994 | Shaw et al. | 52/678 |
| 5,402,614 | A | 4/1995 | Jewell | |
| 5,475,950 | A | 12/1995 | Palmer | |
| 5,848,502 | A | 12/1998 | Schaefer | |
| 6,092,342 | A | 7/2000 | Sharapata | |
| 6,347,489 | B1 * | 2/2002 | Marshall et al. | 52/169.9 |
| 6,612,533 | B2 * | 9/2003 | Biles et al. | 248/354.1 |
| 6,679,023 | B2 * | 1/2004 | Rizzotto | 52/653.2 |
| 7,219,873 | B2 | 5/2007 | Harwood | |
| 7,228,661 | B2 * | 6/2007 | Rizzotto | 52/170 |
| 7,343,713 | B2 * | 3/2008 | Knepp et al. | 52/126.1 |
| 7,387,967 | B2 | 6/2008 | Ogawa et al. | |
| 8,522,503 | B1 | 9/2013 | Egan, Jr. | |
| 8,959,857 | B1 * | 2/2015 | Lin | 52/296 |

* cited by examiner

POST-FRAME FOOTING ASSEMBLY AND VERTICAL POST

CROSS REFERENCE TO RELATED APPLICATION

This application claims the benefit of U.S. Provisional Application No. 61/936,987 filed on Feb. 7, 2014. The above identified patent application is herein incorporated by reference in its entirety to provide continuity of disclosure.

BACKGROUND OF THE INVENTION

1. Field of the Invention

The present invention relates to post-frame construction techniques and methods of securing a vertical post in the ground. More specifically, the present invention relates to an improved post footing that increases load bearing capability, as well as placement and flexibility during construction in post-frame construction structures.

Post-frame construction is a popular construction technique that involves utilizing large, upright posts to frame a structure and provide vertical support for horizontal members. Generally the upright posts are either buried into the ground or supported on a concrete foundation, whereby the latter are generally fastened to the foundation for stability. The present invention relates to a new and improved footing for a vertical post used in post-frame construction, whereby several drawbacks in the art are overcome and improved utility is provided to the builder.

Several problems exist with this method of construction when burying the posts. First, the holes need to be drilled into the ground and require specific spacing and placement to align several posts. Augers and other drills can tend to walk, making such holes sometimes misaligned or overly enlarged for accurate placement. When placing the pole into the hole, the post must be vertical for proper loading. An inaccurate hole causes the hole to be opened and less support to be given to the pole once placed in its proper location.

Another issue with post-frame posts is that once the post is installed and the hole is backfilled, the posts are only designed receive downward vertical loads. Side loads and lift loads are not accommodated, as the post is not supported laterally or vertically upward by anything other than bearing loads against the foundation (lateral loads) and sliding friction against the hole (vertical loads). During high wind events, both side loading and vertical lifting loads can cause buried posts to shift within their holes, or be removed altogether. This can be catastrophic for the structure and cause considerable damage.

The present invention provides a new post footing assembly that is adapted to overcome these drawbacks in the art, whereby improved structural integrity and improved installation are facilitated. The assembly comprises a new post and post footing that are slidably connected to one another. The post footing comprises a bridge plate and a post rail assembly, whereby the bridge plate and post rail assembly are also slidably connected to one another. The lower portion of the vertical post is slidably connected to the post rail assembly, whereby the post footing in its entirely provides two directional adjustment within the plane of the post footing. This allows positional adjustment of the post with respect to the footing once positioned in the hole. The post furthermore comprises a telescoping structure that allow for height adjustment. The post footing assembly accepts downward gravity loads, vertical uplift loading, and lateral side loading once installed. The assembly furthermore allows for incremental adjustment within the hole after placement thereinto in the instance the hole is not perfectly aligned with the adjacent structure.

2. Description of the Prior Art

Devices have been disclosed in the prior art that relate to pole and column supports. However, many of these devices generally relate to different construction techniques than that contemplated herein. Specifically, much of the prior art relates to general column or post support, and not to assemblies that provide for positional adjustment or improved loading capacity when supporting post-frame construction columns within an excavated and backfilled hole. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 8,522,503 to Egan, Jr., which discloses a precast surround for an upright utility pole. As noted above, the Egan, Jr. device is related to a column support that improves the foundation upon which the utility pole rests, but is not adapted for post-frame construction, for facilitating positional adjustment of the pole, or for improving load capacity at the base of the pole. The present invention is related to a support structure that improves post-frame construction methods and the support of vertical posts in structures using such a construction technique.

Another device in the art is U.S. Pat. No. 5,475,950 to Palmer, which discloses concrete footing form section that supporting an upright member and forms drain tails integral with the form. Palmer similarly does not pertain to post-frame construction and is directed to a footing that assists with drainage from concrete foundations. The present invention discloses a footing that is adapted to be backfilled within a foundation, however the present invention relates to positioning a vertical post in a post-frame construction structure and to increasing the load capacity thereof.

Still other devices in the prior art relate to various supports for columns and posts. While structures exist for supporting column loads and side loads, the present invention advances the art of vertical post support devices in the art by facilitating both positional adjustment and improved load capacity of the vertical member. The present invention supports vertical gravity loading, vertical uplift loading, and side loading, whereby the load is transferred to the footing assembly positioned within an excavated and backfilled hole. Furthermore, the present invention comprises several slidable adjustments, whereby positional adjustment of the post within the hole is easily achieved, while the vertical extent of the post can additionally be adjusted using its telescoping construction.

Overall, the present invention is a structure that improves installation procedures for post-frame construction structures, and increases the loading capacity of the vertical posts once installed. The positional adjustability of the post relative to the footing accounts for misplaced holes, while the footing assembly improves the structural capacity of the post by transferring vertical loading and side loads into the footing. It is submitted that the present invention substantially diverges in design elements from the prior art, and consequently it is clear that there is a need in the art for an improvement to existing post-frame construction techniques and structures therefor. In this regard the instant invention substantially fulfills these needs.

SUMMARY OF THE INVENTION

In view of the foregoing disadvantages inherent in the known types of post-frame construction techniques now present in the prior art, the present invention provides a new post-frame construction assembly that greatly improves installation and structural capability of a vertical post in structures built using post-frame construction.

It is therefore an object of the present invention to provide a new and improved post-frame construction technique that has all of the advantages of the prior art and none of the disadvantages.

It is another object of the present invention to provide a post-frame construction assembly that comprises a footing assembly and a vertical post assembly, whereby the footing assembly is positioned within an excavated hole and the vertical post extends upwards therefrom.

Another object of the present invention is to provide post-frame construction assembly having a footer assembly that allows for movement of the vertical post within the excavated hole to facilitate proper alignment of the vertical post with adjacent posts and the required location of the vertical post relative to the structure to be supported.

Yet another object of the present invention is to provide post-frame construction assembly that increases the load capacity of a vertical post in post-frame construction structures, whereby vertical uplift load, vertical downward load, and side loads are transferred to the footing assembly.

Another object of the present invention is to provide post-frame construction assembly that improves installation of vertical posts during construction, improving efficiency of installation and accounting for minor misalignments during construction.

Another object of the present invention is to provide post-frame construction assembly that comprises an aluminum or coated material that resists corrosion when exposed to environmental conditions.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
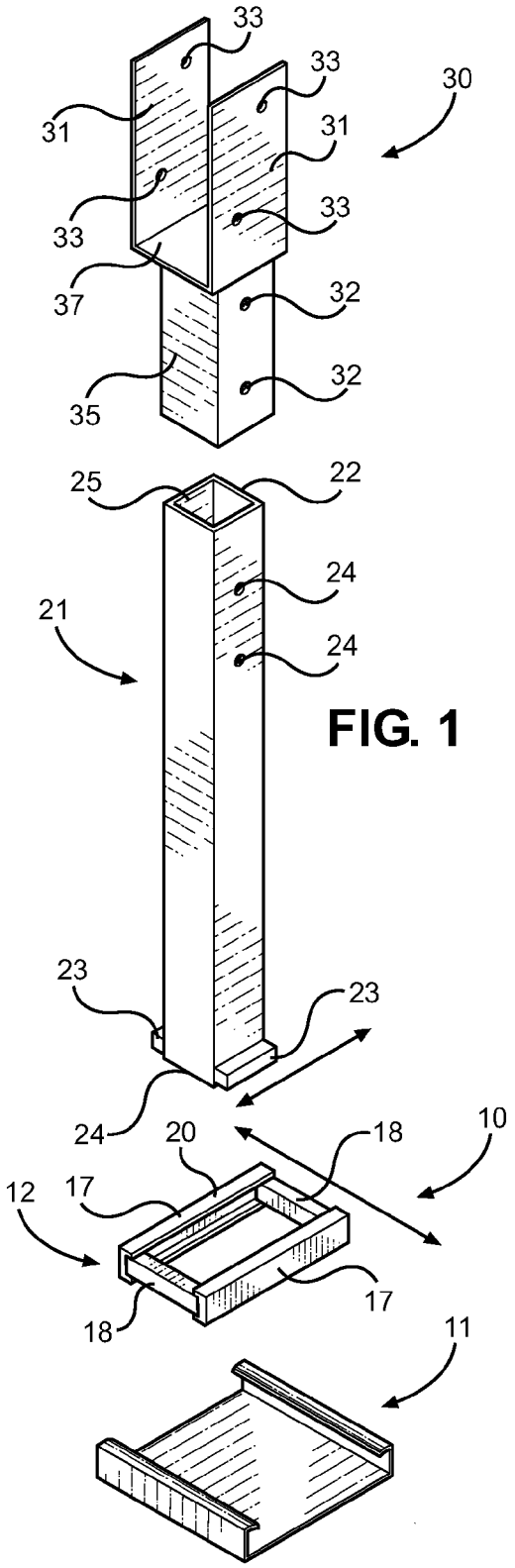
FIG. 1 shows an exploded view of the post-frame assembly of the present invention.

Reference is made herein to the attached drawings. Like reference numerals are used throughout the drawings to depict like or similar elements of the post-frame construction assembly of the present invention. For the purposes of presenting a brief and clear description of the present invention, the preferred embodiment will be discussed as used for improving methods of construction and installation of vertical posts in a post-frame structure. The figures are intended for representative purposes only and should not be considered to be limiting in any respect.

Referring now to FIG. 1, there is shown an exploded view of the post-frame construction assembly of the present invention. Post-frame construction involves burying vertical posts in the ground or in a foundation, and using the vertical posts to support horizontal and overhead structure when constructing a building. This technique is less expensive and more simplified than other building techniques, and is useful for creating open structures such as farmhouses and stables, as well as enclosed buildings having exterior curtain walls. The posts are positioned within drilled holes and spaced apart from one another. After the posts are installed, the hole is backfilled with soil, stone, and/or concrete to set the post in place. The present invention contemplates a new post and new footing assembly for post-frame construction, whereby efficient installation is achieved and improved loading of the posts is provided.

Referring to FIG. 1, the post-frame construction assembly of the present invention comprises a vertical post member 21 and a footing assembly 10. The footing assembly 10 is comprised of a bridge plate member 11 and a post rail assembly 12 that are in slidable relationship to one another. The bridge plate member 11 comprises upstanding edges that support the post rail assembly 12 therein, whereby the bridge plate 11 forms a sleeve that allows the post rail assembly 12 to slide longitudinally therealong. The post rail assembly 12 is constructed so as to receive the lower end 21 of the vertical post member 21 therein. The vertical post member 21 and the post rail assembly 12 are also connected in a slidable relation to one another, whereby the slidable degree of freedom is orthogonal to the slidable degree of freedom between the bridge plate member 11 and the post rail assembly 12. In this way, the footing assembly 10 facilitates bi-directional positioning of the vertical post member 21 during installation, whereby the post member 21 can be slid fore-aft, and left-to-right within the hole after the bridge plate member 11 is positioned therein.

The post rail assembly 12 comprises a substantially rectangular structure having an open interior 19, a pair of side rails 17, and a pair of end members 18. The lower end 21 of the vertical post member 21 further comprises a pair of laterally extending slide members 23 that are adapted to be received within the side rails 17 of the post rail assembly 12. An installer places the lower end 24 of the post 21 within the interior of the post rail 12 and rotates the post 21 such that the slide members 23 engage the U-shaped channels 20 of the side rails 17. The channels 20 of the side rails are disposed along the interior of the post rail assembly 12 and allow the slide members 23 slide therealong from one end member 18 to the other and along the extent of the open interior 19 thereof. Both side rails 17 include a channel 20 along the interior side thereof (not shown in FIG. 1). This facilitates adjustment of the vertical post 21 within the hole along the side rails 17, without having to move the location of the hole or the bridge plate member 11 within the hole.

Furthermore, the post rail assembly 12 is slidable along the bridge plate member 11, and in a similar manner provides positional adjustment in an orthogonal direction with respect to the vertical post/post rail connection. Together, the footing assembly 10 allows movement of the vertical post in a two dimensional space defined by a plane extending through the footing assembly 10 that is orthogonal to the vertical length of the vertical post 21 (in plane with the footing assembly 10). Therefore, once the footing assembly 10 is secured to the vertical post 21 and the assembly is placed within a hole, the post 21 can be accurately located with respect to adjacent posts and with regard to the overall structure being installed. This is critical in events where the hole is not located perfectly and if the drilling tool "walked" or moved from its intended position during the excavation process. The need to re-drill the hole or account for misaligned posts is eliminated. The post can be positioned in the proper position within a larger hole by slide the post 21 within the post rail assembly 12, and furthermore by sliding the post rail assembly 12 within the bridge plate member 11.

Figure 2:
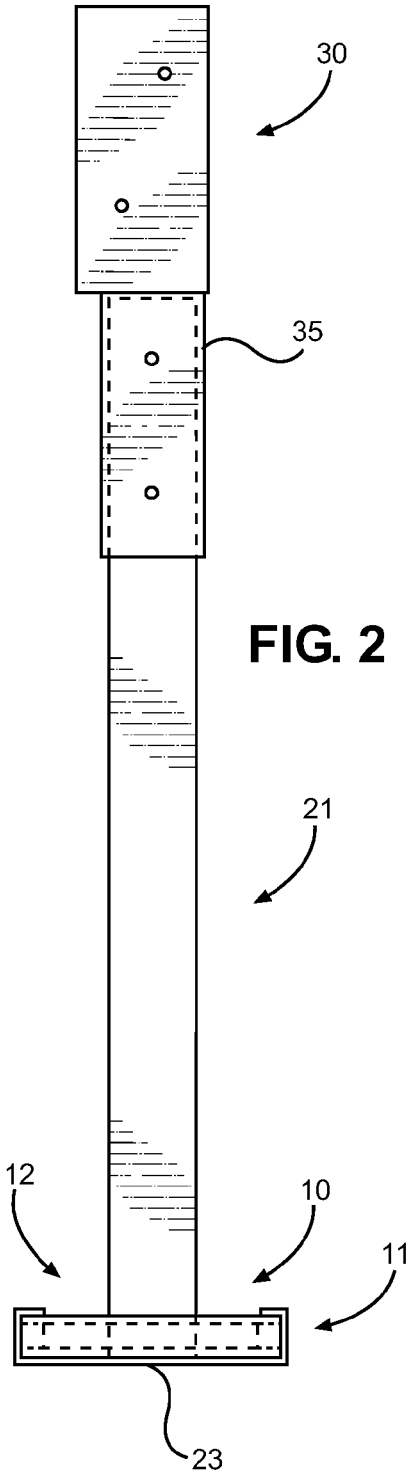
FIG. 2 shows a side view of the post-frame assembly of the present invention.

Turning to the vertical post member 21, this assembly is comprised of an elongated, tubular member having an lower end 24 securable to the footing assembly 10 and an upper end 25 adapted to receive an upper support member 30. The upper support member 30 may comprise a separate structure connectable to the upper end 25 of the vertical post, or in some embodiments the upper support member 30 may be integrally formed to the upper end 25 of the vertical post (single piece construction). The embodiment of the present invention as presented in FIGS. 1 and 2 represent a two-part post construction. The upper support member 30 comprises a lower socket member 35 that is received by the open upper 25 of the vertical post 21. The two are secured together via fasteners through aligned fastener holes 24, 32. Optionally, this connection may be provided as a translational joint, whereafter the two are bolted together using aligned fastener holes 24, 32. In the alternative configuration, the two members form a telescoping construction to allow for vertically positioning of the upper support member 30 relative to the vertical post 21.

The upper support member 30 comprises an upstanding, U-shaped member and a lower socket member 35. The U-shaped member is formed from a first and second upstanding flange 31 and a lower surface 37, wherebetween a wooden beam or similar structural member of the building is supported therein. The beam is secured therein using fasteners, which are driven into the beam and through fastener holes 33 through the upstanding flanges 31. The upper support member 30 extends above the hole in the foundation and is used to connect the vertical post 21 to a beam structure of the building being constructed.

Referring now to FIG. 2, there is shown a side view of the present invention in a working state, whereby the vertical post 21 is secured to the footing assembly 10, and the upper support member 30 is connected to the upper end of the vertical post 21. As shown, the bridge plate member 11 slidably supports the post rail assembly 12 therein, whereby the post rail assembly 12 can be slidable positioned along the length of the bridge plate member 11. The slide members 23 of the vertical post 21 engage the channels of the post rail assembly 12 to provide a second degree of freedom, thereby allowing bi-directional positioning of the vertical post 21 relative to the bridge plate member 11. Along the upper end of the post member 21, the upper support member 30 is positioned thereover, whereby the lower socket member 35 engages the upper portion of the vertical post 21 and is fastened thereto.

In this state, the upper support member 30 is exposed to support a beam that is used in the construction of the structure being erected. Load is transferred through the upper support member 30 and into the vertical post 21. The same load is transmitted to the footing assembly 10. The footing assembly 10 counteracts the load by supporting the vertical post during side-loading of the post and during uplift or downward loads on the post 21.

Figure 3:
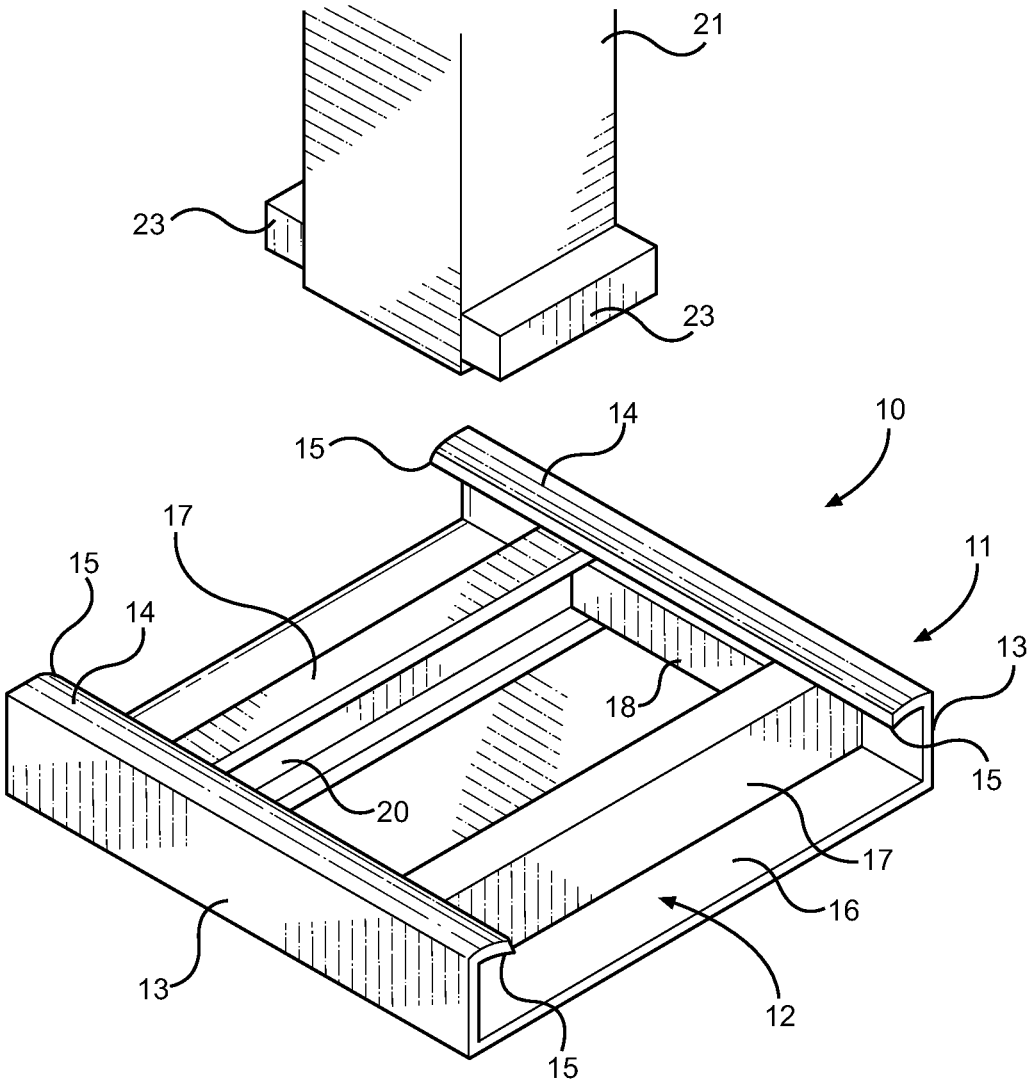
FIG. 3 shows a view of the footing assembly and the base of the vertical post assembly.

Referring now to FIG. 3, there is shown a close-up view of the footing assembly 10 of the present invention. The footing assembly 10 is comprised of the bridge plate member 11 and the post rail assembly 12. The bridge plate member 11 comprises a lower surface 16, a first and second upstanding flange 13, and an inward lip 14 extending inward from the upstanding flanges 13. The bridge plate member 11 forms a substantially U-shaped member within which the post rail assembly 12 can translate in one direction. To prevent the post rail assembly 12 from translating through the ends of the bridge plate member 11, the outer corners 15 of the inward flanges 14 are flared downward. This blocks translation of the post rail assembly 12 beyond this point and marks the outer limit of the allowable post rail assembly translation.

The post rail assembly 12 comprises an open, rectangular structure having an open interior, a pair of side rails 17, and a pair of end members 18. Along the inner side of the side rails 17 is a channel 20, whereby the channels 20 of the assembly oppose one another and are adapted to slidably receive the slide members 23 of the vertical post 21 therein. The end members 18 of the post rail assembly 12 mark the outer extent of the translational movement of the vertical post 21 within the post rail assembly.

Figure 4:
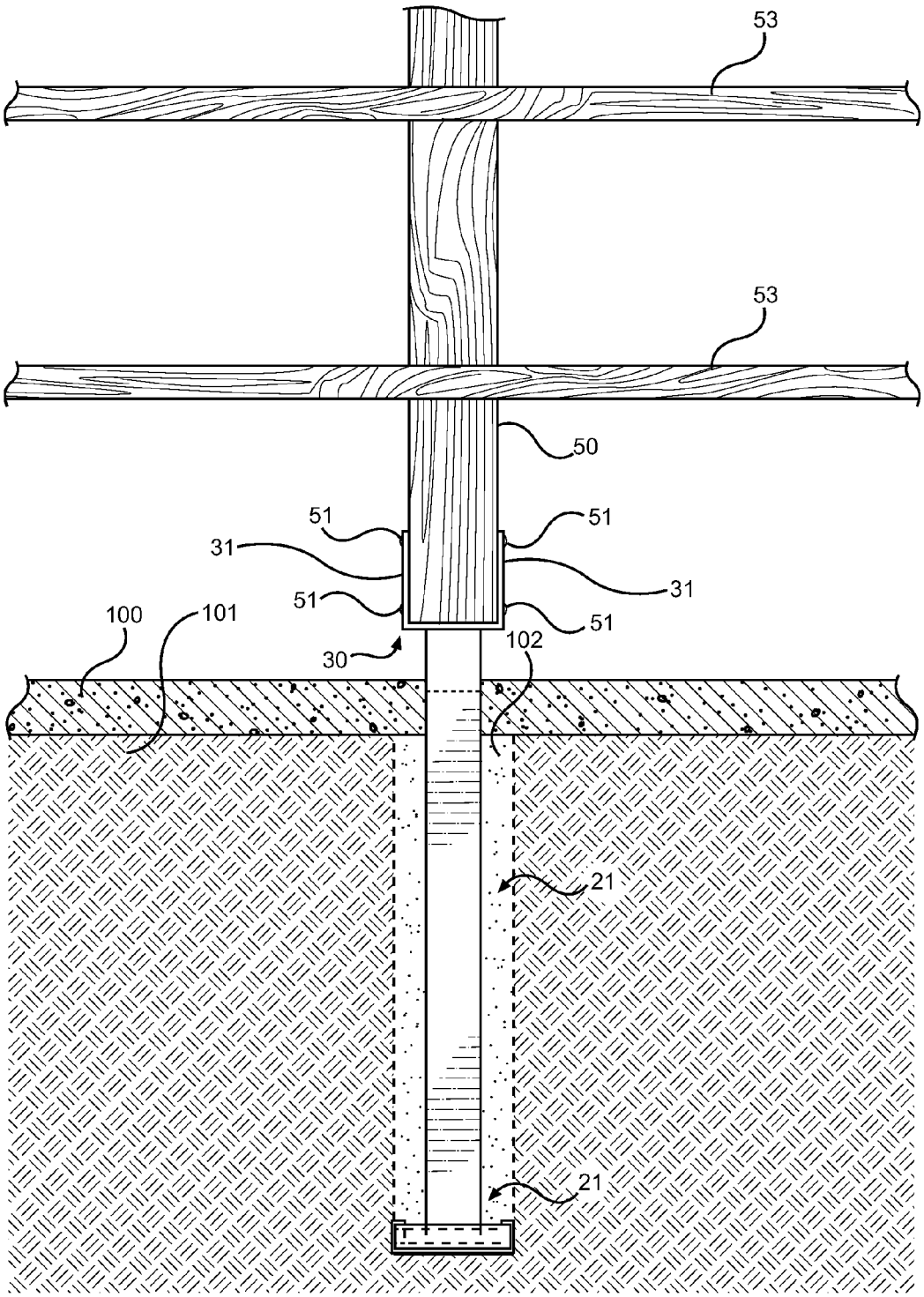
FIG. 4 shows a view of the post-frame assembly installed within an excavated and backfilled hole during construction.

Referring now to FIG. 4, there is shown a view of the post-frame assembly installed within a drilled hole 102 and supporting a beam 50 within its upper support member 30. The beam 50 is disposed between the upstanding flanges 31 of the upper support member 30 and are fastened thereto using appropriate fasteners 51. The vertical post is substantially disposed within the backfilled hole 102. The hole 102 is a drilled out volume disposed within the ground 101 that is adapted to receive both the footing assembly 10 and the vertical post 21. The vertical post 21 and the footing assembly 10 are lowered into the hole 102, and thereafter adjusted within the hole until the vertical post 21 is located properly relate to the structure being supported. The hole 102 is then backfilled and the foundation 100 is poured thereover. The upper support member 30 is partially or fully exposed from the foundation 100 and supports the beam 50 of the building. In turn, the beam supports horizontal members 53 that make up the structure of the building be erected.

Overall, the present invention provides an improved installation assembly for use in post-frame construction. The footing assembly allows for positioning of the vertical post, while maintain the vertical post in a vertical orientation and without requiring the installer to reposition the hole in order to properly align the post. The footing assembly furthermore is adapted to receive vertical uplift, downward vertical loads, and side loads after installation. This increases the load capacity of the vertical post beyond what is capable through use of a buried vertical post along (i.e. without a footing assembly). Finally, the footing assembly and the vertical post are preferably an aluminum coated material that will not corrode over time after installation.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A post-frame construction assembly, comprising:

a footing assembly comprising a bridge plate member and a post rail assembly;

said post rail assembly being disposed within said bridge plate member and said post rail assembly being slidably positionable within said bridge plate member in a first direction;

a vertical post member comprising a lower end and an upper end;

said lower end being disposed within said post rail assembly and said lower end being slidably positionable within said post rail assembly in a second direction;

said first direction and said second direction being orthogonal and in a plane parallel to said footing assembly;

said upper end of said vertical post member comprising a substantial U-shape.

2. The post-frame construction assembly of claim 1, wherein:

said bridge plate member further comprises a lower surface, a first and second upstanding flange extending upward therefrom to form a substantial U-shape, and an inward lip extending inward from each upstanding flange;

said post rail assembly being slidably disposed within said substantial U-shape of said bridge plate member.

3. The post-frame construction assembly of claim 2, wherein:

each inward lip further comprises outer corners;

said outer corners being flared downward to secure said post rail assembly within said bridge plate member.

4. The post-frame construction assembly of claim 1, wherein:

said post rail assembly further comprises a substantially rectangular structure having an open interior, a pair of side rails, and a pair of end members;

said side rails having an inner side;

each inner side further comprising a channel;

each channel being configured to slidably receive said lower end of said vertical post.

5. The post-frame construction assembly of claim 1, wherein:

said vertical post further comprises slide members extending outward from said lower end thereof, said slide members configured to be slidably received by said post rail assembly.

6. The post-frame construction assembly of claim 1, wherein:

said upper end of said vertical post further comprises a first and second upstanding flange and a lower surface forming said substantial U-shape.

7. The post-frame construction assembly of claim 1, wherein:

said substantial U-shape of said upper end further comprises an upper support member removably connected to said upper end of the vertical post;

said upper support member further comprising a first and second upstanding flange and a lower surface forming said substantial U-shape, and a lower socket member configured to secure to said upper end of said vertical post.

8. A method of post-frame construction, comprising the steps of:

excavating a hole to receive a vertical post;

securing a vertical post to a footing assembly;

allowing bi-directional adjustment of said vertical post relative to said footing assembly using a post rail assembly in slidable connection with a bridge plate member, and said post rail assembly in slidable connection with said vertical post;

supporting said vertical post in a vertical orientation using said foot assembly;

placing said footing assembly and said vertical post into said hole;

slidably positioning said vertical post within said hole;

backfilling said hole;

said post rail assembly is slidably positionable within said bridge plate member in a first direction;

said vertical post is disposed within said post rail assembly and said vertical post is slidably positionable within said post rail assembly in a second direction;

said first direction and said second direction being orthogonal and in a plane parallel to said footing assembly.

* * * * *